US006946431B2

(12) United States Patent
Yeo et al.

(10) Patent No.: US 6,946,431 B2
(45) Date of Patent: Sep. 20, 2005

(54) CLEANING SOLUTION INCLUDING AQUEOUS AMMONIA SOLUTION, ACETIC ACID AND DEIONIZED WATER FOR INTEGRATED CIRCUIT DEVICES AND METHODS OF CLEANING INTEGRATED CIRCUIT DEVICES USING THE SAME

(75) Inventors: In-Joon Yeo, Gyeonggi-do (KR); Yong-Sun Ko, Gyeonggi-do (KR); In-Seak Hwang, Gyeonggi-do (KR); Byoung-Moon Yoon, Gyeonggi-do (KR); Dae-Hyuk Chung, Gyeonggi-do (KR); Kyung-Hyun Kim, Seoul (KR)

(73) Assignee: Samsung Electronics Co., Ltd. (KR)

( * ) Notice: Subject to any disclaimer, the term of this patent is extended or adjusted under 35 U.S.C. 154(b) by 208 days.

(21) Appl. No.: 10/655,421

(22) Filed: Sep. 4, 2003

(65) Prior Publication Data

US 2004/0097389 A1 May 20, 2004

(30) Foreign Application Priority Data

Nov. 18, 2002 (KR) ..... 10-2002-0071659

(51) Int. Cl.[7] ..... H01L 21/302

(52) U.S. Cl. ..... 510/175; 510/176; 134/1.3; 134/2; 134/3

(58) Field of Search ..... 510/175, 176; 134/1.3, 2, 3

(56) References Cited

U.S. PATENT DOCUMENTS 6,399,552 B1 * 6/2002 Lee et al. ..... 510/175
6,432,826 B1 * 8/2002 Emami et al. ..... 438/692

FOREIGN PATENT DOCUMENTS

JP 60007233 1/1985
KR 1999-57778 12/1999

* cited by examiner

*Primary Examiner*—Gregory E. Webb
(74) *Attorney, Agent, or Firm*—Myers Bigel Sibley & Sajovec

(57) ABSTRACT

Cleaning solutions for integrated circuit devices and methods of cleaning integrated circuit devices using the same are disclosed. The cleaning solution includes about 30% aqueous ammonia solution, acetic acid by a volume percent higher then a volume percent of the aqueous ammonia solution, and deionized water by a volume percent higher then the volume percent of the acetic acid. Additionally, disclosed are methods wherein the cleaning solution is formed on integrated circuit substrates having an exposed metal pattern formed thereon, and further providing mega-sonic energy to the film of the cleaning solution.

36 Claims, 2 Drawing Sheets

CLEANING SOLUTION INCLUDING AQUEOUS AMMONIA SOLUTION, ACETIC ACID AND DEIONIZED WATER FOR INTEGRATED CIRCUIT DEVICES AND METHODS OF CLEANING INTEGRATED CIRCUIT DEVICES USING THE SAME

CROSS REFERENCE TO RELATED APPLICATIONS

The present application claims priority to Korean Patent Application 2002-71659, filed Nov. 18, 2002, the disclosure of which is hereby incorporated herein by reference in its entirety as if set forth fully herein.

BACKGROUND OF THE INVENTION

1. Field of the Invention

The present invention relates to a cleaning solution for an integrated circuit device and methods of cleaning integrated circuit devices using the same. More particularly the present invention relates to a cleaning solution for cleaning an integrated circuit device having an exposed metal pattern and methods of cleaning an integrated circuit device having an exposed metal pattern using the same.

2. Description of the Related Art

In the fabrication of integrated circuit devices, the importance of minimizing contamination has been recognized since the early days of the industry. However, as the end product devices have become more and more miniaturized and complex, the cleanliness requirements may become increasingly more stringent so that the devices may function properly. Due to the reduced size of the devices, a contaminant occupies an increased percentage of the available space for current elements, and hence cleanliness of the materials may become more desirable. During the process of manufacturing an integrated circuit device, patterns and wirings of the integrated circuit device may be formed using various materials and manufacturing steps. Accordingly, after each manufacturing step is performed, impurities or other particles may be removed from a surface of an integrated circuit substrate in order to reduce or prevent the integrated circuit device from being polluted.

Previously, cleaning processes for integrated circuit substrates have been executed using such methods as bubbling inert gases, magnetic stirring, and/or sonicating. It is generally known in the art that in a wet cleaning process, impurities from the surface of an integrated circuit device may be removed in accordance with either processing temperature, a pre-treatment of the integrated circuit device, a composition of the cleaning solution, a power intensity of the sonic energy and the like. In one such example, a sonic energy transformer is installed in the cleaning container and the sonic energy is applied to an integrated circuit device through a wall of the cleaning container and the cleaning solution. The sonic energy can then accelerate a cleaning mechanism by forming bubbles in the cleaning solution. The bubbles formed in the cleaning solution are then exploded by an explosion energy and the temperature of the bubbles generated by the sonic energy so that the impurities can be physically removed from the surface of an integrated circuit device.

Japanese Patent Laid Open Publication No. 60-7233 discloses a method of cleaning an integrated circuit device using a cleaning solution including hydrogen chloride, ammonia and hydrogen peroxide solution. The hydrogen chloride may be used to remove aluminum, magnesium, iron, or slightly alkaline ions, and can prevent their substitutional replating in the cleaning solution. Therefore, the cleaning solution including the hydrogen chloride may not be desirable for cleaning an integrated circuit device having an exposed metal pattern. Additionally in this process, the hydrogen peroxide solution may generate bubbles from oxygen dissolved, yet the hydrogen peroxide solution generally removes the metal pattern when the metal pattern is composed of aluminum and therefore may not be desirable for cleaning an integrated circuit device having an exposed metal pattern. Furthermore, the ammonia in this reactive solution forms amino complexes by reacting with heavy metals such as cadmium, cobalt, copper, mercury, nickel or silver.

Another example of a cleaning solution presently utilized for cleaning an integrated circuit device is Korean Patent Laid Open Publication No. 2001-56346. This example discloses a method of cleaning an integrated circuit device using a cleaning solution including ammonia. However, the exposed minute metal wiring of the integrated circuit device may be corroded by this cleaning solution. Therefore, this solution may also not be desirable for cleaning an integrated circuit device.

Accordingly, it may be beneficial to provide a cleaning solution or new methods of cleaning an integrated circuit device to prevent damage to the integrated circuit device.

SUMMARY OF THE INVENTION

Embodiments of the present invention may include a cleaning solution for cleaning an integrated circuit device in order to reduce or prevent damage of a metal pattern such as a corrosion of the metal pattern. In accordance with these embodiments, the cleaning solution for cleaning integrated circuit devices includes about 30% aqueous ammonia solution, acetic acid by a volume percent higher than a volume percent of the about 30% aqueous ammonia solution, and deionized water by a volume percent higher than the volume percent of the acetic acid. Some embodiments may include a volume ratio among the about 30% aqueous ammonia solution, the acetic acid and the deionized water wherein the ratio may be about 1:1 to 100:1,000 to 100,000.

The present invention also provides embodiments relating to methods of cleaning integrated circuit devices that can reduce, minimize or prevent damage on a fine pattern of the integrated circuit device. In these embodiments, a film of a cleaning solution may be formed on an integrated circuit substrate having an exposed metal pattern formed thereon. The cleaning solution includes about 30% aqueous ammonia solution, acetic acid, and deionized water. After the film is formed, a blast of mega-sonic energy may be applied to the film of the cleaning solution. The integrated circuit substrate having the exposed metal pattern is then cleaned by a chemical reaction of the cleaning solution, the mega-sonic energy and an energy generated by an explosion of a bubble in the cleaning solution due to the mega-sonic energy. In some embodiments, the integrated circuit device may be immersed in the cleaning solution. In other embodiments, the integrated circuit device may have a film of a cleaning solution formed on the integrated circuit device.

Additionally, some embodiments of the present invention provide for methods of cleaning an integrated circuit device comprising applying mega-sonic energy to a cleaning solution wherein the cleaning solution comprises about 30% aqueous ammonia solution, acetic acid and deionized water.

Other embodiments of the present invention additionally provide methods of cleaning integrated circuit devices having an exposed fine metal pattern. In accordance with other embodiments of the present invention, an integrated circuit device having an exposed fine metal pattern may be immersed into a cleaning solution including about 30% aqueous ammonia solution, acetic acid and deionized water. Then, mega-sonic energy may be applied to the cleaning solution. The integrated circuit device having an exposed fine metal pattern is cleaned by a chemical reaction of the cleaning solution, the mega-sonic energy and an energy generated by an explosion of bubbles in the cleaning solution due to the mega-sonic energy.

Additionally, embodiments of the present invention may include integrated circuit substrates having exposed aluminum patterns formed thereon. These integrated circuit substrates may be cleaned using a cleaning solution including about 30% aqueous ammonia solution, acetic acid and deionized water and by employing mega-sonic energy from about 10 W to 100 W.

Accordingly, embodiments of the present invention may provide improved cleaning methods for integrated circuit devices.

DETAILED DESCRIPTION OF THE PREFERRED EMBODIMENTS

Figure 1:
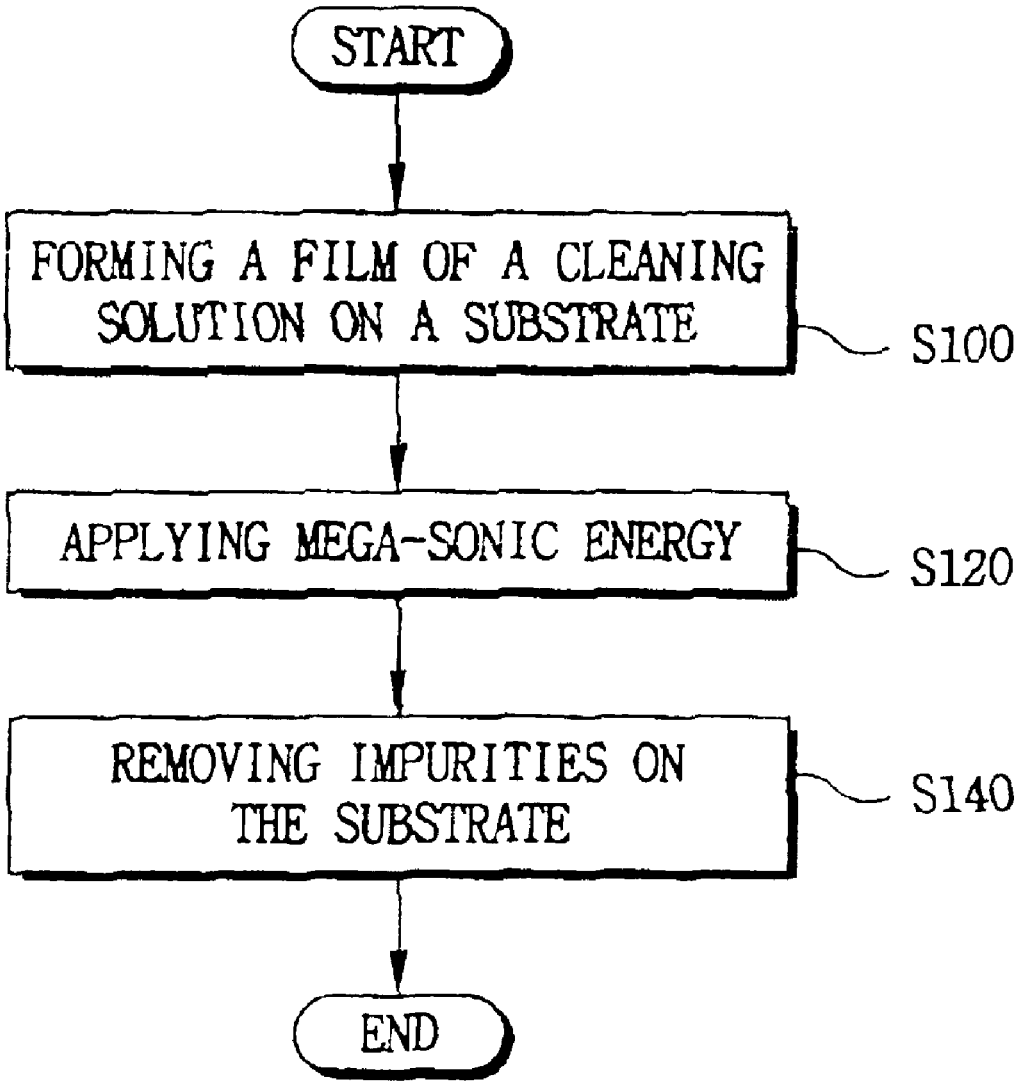
FIG. 1 is a flow chart illustrating a method of cleaning device including exposed metal patterns using a cleaning solution according to one embodiment of the present invention.

The foregoing and other aspects of the present invention will now be described in more detail with respect to the embodiments described herein. It should be appreciated that the invention may be embodied in different forms and should not be construed as limited to the embodiments set forth herein. Rather, these embodiments are provided so that this disclosure will be thorough and complete, and will fully convey the scope of the invention to those skilled in the art.

It will be understood that when an element such as a layer, a region or a substrate is referred to as being "on" another element, it can be directly on the other element or intervening elements may also be present. It will be understood that if part of an element, such as a surface of a conductive line, is referred to as "outer", it is closer to the outside of the integrated circuit than other parts of the element. Furthermore, relative terms such as "beneath" may be used herein to describe a relationship of one layer or region to another layer or region relative to a substrate or a base layer as illustrated in the figures. It will be understood that these terns are intended to encompass different orientations of the device in addition to the orientation depicted in the figures. Finally, the term "directly" means that there are no intervening elements.

Some embodiments of the present invention include a cleaning solution that may be employed in order to clean an integrated circuit device. The integrated circuit device may include exposed metal patterns, for example, aluminum patterns. The cleaning solution may include about 30% aqueous ammonia solution, acetic acid and deionized water. The 30% aqueous ammonia solution can be 10%, 20%, 40%, 50%, up to 99% aqueous ammonia solution. Generally, a volume ratio of the acetic acid is higher than that of the ammonia, and a volume ratio of the deionized water is higher than that of the acetic acid.

The volume ratio among the about 30% aqueous ammonia solution, the acetic acid and the deionized water is about 1: about 1 to 100: about 1,000 to 100,000. When a volume ratio of the about 30% aqueous ammonia solution is higher than that of the acetic acid, the exposed metal patterns may be corroded. When the volume ratio of the acetic acid is greater than that of the about 30% aqueous ammonia solution by more than about one hundred times, impurities on an integrated circuit substrate. When the volume ratio of the deionized water is less than that of the about 30% aqueous ammonia solution by less than about one thousand times, the metal patterns may be corroded. When the volume ratio of the deionized water is greater than that of the about 30% aqueous ammonia solution by more than about one hundred thousand times, the impurities may not be removed from the integrated circuit substrate and an entire volume of the cleaning solution is disadvantageously augmented or the volume ratios of the about 30% aqueous ammonia solution and the acetic acid may be undesirably increased so that a cleaning process may be complicated.

The difference between the cleaning solution and the deionized water when the cleaning solution has a potential of Hydrogen (pH) of about 7 as a neutral solution can be miniscule. On the contrary, when the cleaning solution has a pH of more than about 7 as a basic solution, the cleaning solution can corrode the exposed metal patterns formed on the substrate. Therefore, it may be advantageous when the cleaning solution has a pH of less than about 6.5.

Hereinafter, methods of cleaning an integrated circuit device using the above-mentioned cleaning solutions will be described.

FIG. 1 is a flow chart illustrating a method of cleaning an integrated circuit device including an exposed metal pattern using a cleaning solution according to embodiments of the present invention.

Referring to FIG. 1, a cleaning solution including ammonia, acetic acid and deionized water is provided onto an integrated circuit substrate including exposed metal patterns, thereby forming a film of the cleaning solution on an integrated circuit substrate (step S100). The cleaning solution is sprayed onto the integrated circuit substrate with a low spray pressure. The cleaning solution is continuously provided onto the integrated circuit substrate during a cleaning process so that the film of the cleaning solution is constantly maintained on the integrated circuit substrate.

Mega-sonic energy is applied to the film of the cleaning solution in the next step (step S120). The mega-sonic energy is applied from a mega-sonic bar that is provided over the integrated circuit substrate before or after forming of the film of the cleaning solution. In some embodiments, the mega-sonic bar has a length equal to or slightly longer than a radius of the integrated circuit substrate. Thus, the mega-sonic energy can be applied to an entire face of the integrated circuit substrate while the integrated circuit substrate is rotated.

When the mega-sonic energy is applied to the film of the cleaning solution, bubbles in the film of the cleaning solution are exploded due to the vibration of materials composing the film of the cleaning solution. As a result, impurities on the integrated circuit substrate are removed by the explosion energy of the bubbles and a chemical reaction of the cleaning solution so that the integrated circuit substrate is cleaned (step S140).

A process for the formation of the film of the cleaning solution will be described in detail.

The cleaning solution may be continuously sprayed onto an integrated circuit substrate. The cleaning solution may be provided onto a central portion of an integrated circuit substrate. The integrated circuit substrate may be simultaneously rotated while the cleaning solution is sprayed. Alternatively, the integrated circuit substrate is rotated after the cleaning solution is sufficiently provided onto the integrated circuit substrate. Hence, the film of the cleaning solution can be uniformly formed on the integrated circuit substrate. In some embodiments, the integrated circuit substrate is rotated at a low speed of about 8 to 50 rpm in order to form the film of the cleaning solution having a thickness of about 0.7 to 2.7 mm. When the film of the cleaning solution has such thickness, the cleaning solution can sufficiently remove impurities from the integrated circuit substrate. In case that the impurities are removed from the integrated circuit substrate, deionized water is provided to rinse the integrated circuit substrate, and then the rinsed integrated circuit substrate is dried.

Physical and chemical cleaning processes that may be performed by the cleaning solution will be described in detail.

After the film of the cleaning solution is uniformly formed on the integrated circuit substrate in accordance with the rotation of the integrated circuit substrate, the mega-sonic energy is applied to the film of the cleaning solution so that polymers and impurities on the integrated circuit substrate are chemically removed by chemical reactions with the ammonia and the acetic acid of the cleaning solution. Additionally, ammonia gases saturated in the cleaning solution are exploded by the mega-sonic energy so that impurities on the integrated circuit substrate are physically removed by the explosion energies of the ammonia gases and a temperature.

Figure 2:
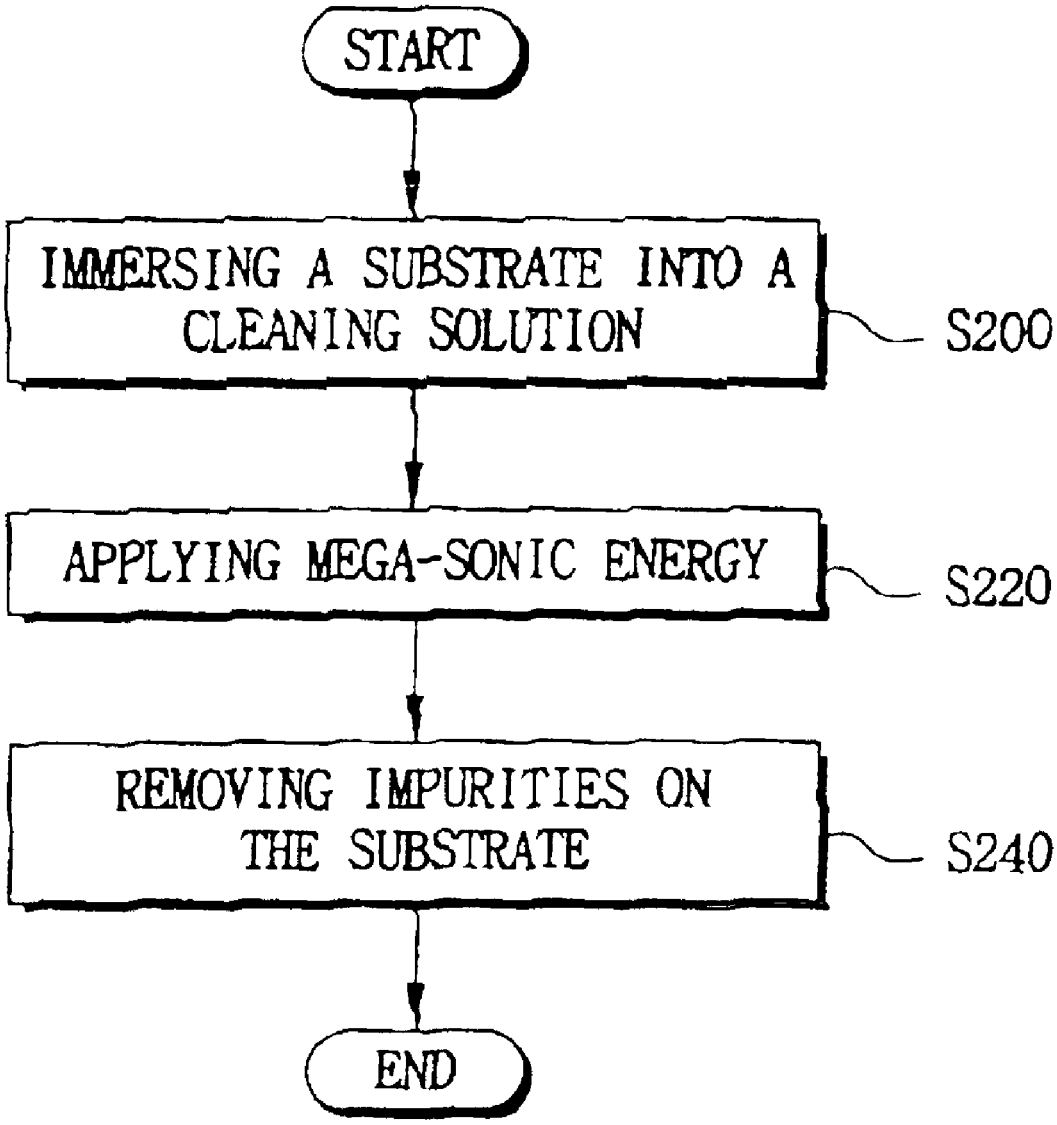
FIG. 2 is a flow chart illustrating a method of cleaning device including exposed metal patterns using a cleaning solution according to another embodiment of the present invention.

FIG. 2 is a flow chart illustrating other methods of cleaning an integrated circuit device including exposed metal patterns using cleaning solutions of the present invention.

Referring to FIG. 2, an integrated circuit substrate including exposed metal patterns is immersed into a cleaning solution including ammonia, acetic acid and deionized water (step S200). The cleaning solution is stored in a container having a size large enough to contain the integrated circuit substrate, and in some embodiments the cleaning solution is provided onto an entire face of the integrated circuit substrate.

Mega-sonic energy may then be applied to the cleaning solution (step S220). The container including the cleaning solution transmits the mega-sonic energy to the cleaning solution. Thus, the mega-sonic energy is applied from the outside to entire face of the container including the cleaning solution and the integrated circuit substrate.

The mega-sonic energy may explode bubbles in the cleaning solution. The materials of the cleaning solution are then chemically reacted with impurities on the integrated circuit substrate. As a result, the integrated circuit substrate including the exposed metal patterns is chemically and physically cleaned (step S240).

Hereinafter, various examples and comparative examples of the present invention will be described. These examples are intended as illustrative of the invention and are not to be taken as limiting thereof.

EXAMPLE 1

A cleaning solution including about 30% aqueous ammonia solution, acetic acid and deionized water was prepared. A volume ratio among the about 30% aqueous ammonia solution, the acetic acid and the deionized water was about 1:2:2,000. The cleaning solution was provided onto an integrated circuit substrate including exposed aluminum patterns while the integrated circuit substrate was rotated by a speed of about 20 rpm. At that time, the cleaning solution had a thickness of about 2 mm on the integrated circuit substrate. The cleaning solution was provided at a room temperature for about 30 seconds.

EXAMPLE 2

A cleaning solution including about 30% aqueous ammonia solution, acetic acid and deionized water was prepared. A volume ratio among the about 30% aqueous ammonia solution, the acetic acid and the deionized water was about 1:2:4,000. The cleaning solution was provided onto an integrated circuit substrate including exposed aluminum patterns while the integrated circuit substrate was rotated at a speed of about 20 rpm. At that time, the cleaning solution had a thickness of about 2 mm on the integrated circuit substrate. The cleaning solution was provided at a room temperature for about 30 seconds.

EXAMPLE 3

A cleaning solution including about 30% aqueous ammonia solution, acetic acid and deionized water was prepared. A volume ratio among the about 30% aqueous ammonia solution, the acetic acid and the deionized water was about 1:1:1,000. The cleaning solution was provided onto an integrated circuit substrate including exposed aluminum patterns while the integrated circuit substrate was rotated by a speed of about 20 rpm. At that time, the cleaning solution had a thickness of about 2 mm on the integrated circuit substrate. The cleaning solution was provided at a room temperature for about 30 seconds.

EXAMPLE 4

A cleaning solution including about 30% aqueous ammonia solution, acetic acid and deionized water was prepared. A volume ratio among the about 30% aqueous ammonia solution, the acetic acid and the deionized water was about 1:2:1,000. The cleaning solution was provided onto an integrated circuit substrate including exposed aluminum patterns while the integrated circuit substrate was rotated at a speed of about 20 rpm. At that time, the cleaning solution had a thickness of about 2 mm on the integrated circuit substrate. The cleaning solution was provided at a room temperature for about 30 seconds.

EXAMPLE 5

A cleaning solution including about 30% aqueous ammonia solution, acetic acid and deionized water was prepared. A volume ratio among the about 30% aqueous ammonia solution, the acetic acid and the deionized water was about 1:3:1,000. The cleaning solution was provided onto an integrated circuit substrate including exposed aluminum patterns while the integrated circuit substrate was rotated at a speed of about 20 rpm. At that time, the cleaning solution had a thickness of about 2 mm on the integrated circuit substrate. The cleaning solution was provided at a room temperature for about 30 seconds.

COMPARATIVE EXAMPLE 1

A cleaning solution including about 30% aqueous ammonia solution and deionized water was prepared. A volume ratio between the about 30% aqueous ammonia solution and the deionized water was about 1:8,000. The cleaning solution was provided onto an integrated circuit substrate including exposed aluminum patterns while the integrated circuit substrate was rotated at a speed of about 20 rpm. At that time, the cleaning solution had a thickness of about 2 mm on the integrated circuit substrate. The cleaning solution was provided at a room temperature for about 30 seconds.

COMPARATIVE EXAMPLE 2

A cleaning solution including about 30% aqueous ammonia solution and deionized water was prepared. A volume ratio between the about 30% aqueous ammonia solution and the deionized water was about 1:4,000. The cleaning solution was provided onto an integrated circuit substrate including exposed aluminum patterns while the integrated circuit substrate was rotated at a speed of about 20 rpm. At that time, the cleaning solution had a thickness of about 2 mm on the integrated circuit substrate. The cleaning solution was provided at a room temperature for about 30 seconds.

COMPARATIVE EXAMPLE 3

A cleaning solution including about 30% aqueous ammonia solution and deionized water was prepared. A volume ratio between the about 30% aqueous ammonia solution and the deionized water was about 1:2,000. The cleaning solution was provided onto an integrated circuit substrate including exposed aluminum patterns while the integrated circuit substrate was rotated at a speed of about 20 rpm. At that time, the cleaning solution had a thickness of about 2 mm on the integrated circuit substrate. The cleaning solution was provided at a room temperature for about 30 seconds.

COMPARATIVE EXAMPLE 4

A cleaning solution including about 30% aqueous ammonia solution and deionized water was prepared. A volume ratio between the about 30% aqueous ammonia solution and the deionized water was about 1:1,000. The cleaning solution was provided onto an integrated circuit substrate including exposed aluminum patterns while the integrated circuit substrate was rotated at a speed of about 20 rpm. At that time, the cleaning solution had a thickness of about 2 mm on the integrated circuit substrate. The cleaning solution was provided at a room temperature for about 30 seconds.

COMPARATIVE EXAMPLE 5

A cleaning solution including about 30% aqueous ammonia solution and deionized water was prepared. A volume ratio between the about 30% aqueous ammonia solution and the deionized water was about 1:250. The cleaning solution was provided onto an integrated circuit substrate including exposed aluminum patterns while the integrated circuit substrate was rotated at a speed of about 20 rpm. At that time, the cleaning solution had a thickness of about 2 mm on the integrated circuit substrate. The cleaning solution was provided at a room temperature for about 30 seconds.

COMPARATIVE EXAMPLE 6

A cleaning solution including about 30% aqueous ammonia solution and deionized water was prepared. A volume ratio between the about 30% aqueous ammonia solution and the deionized water was about 1:125. The cleaning solution was provided onto an integrated circuit substrate including exposed aluminum patterns while the integrated circuit substrate was rotated at a speed of about 20 rpm. At that time, the cleaning solution had a thickness of about 2 mm on the integrated circuit substrate. The cleaning solution was provided at a room temperature for about 30 seconds.

COMPARATIVE EXAMPLE 7

A cleaning solution including sulfuric acid and deionized water was prepared. A volume ratio between the sulfuric acid and the deionized water was about 1:2,000. The cleaning solution was provided onto an integrated circuit substrate including exposed aluminum patterns while the integrated circuit substrate was rotated at a speed of about 20 rpm. At that time, the cleaning solution had a thickness of about 2 mm on the integrated circuit substrate. The cleaning solution was provided at a room temperature for about 30 seconds.

COMPARATIVE EXAMPLE 8

A cleaning solution including sulfuric acid and deionized water was prepared. A volume ratio between the sulfuric acid and the deionized water was about 1:1,000. The cleaning solution was provided onto an integrated circuit substrate including exposed aluminum patterns while the integrated circuit substrate was rotated at a speed of about 20 rpm. At that time, the cleaning solution had a thickness of about 2 mm on the integrated circuit substrate. The cleaning solution was provided at a room temperature for about 30 seconds.

COMPARATIVE EXAMPLE 9

A cleaning solution including sulfuric acid and deionized water was prepared. A volume ratio between the sulfuric acid and the deionized water was about 1:500. The cleaning solution was provided onto an integrated circuit substrate including exposed aluminum patterns while the integrated circuit substrate was rotated at a speed of about 20 rpm. At that time, the cleaning solution had a thickness of about 2 mm on the integrated circuit substrate. The cleaning solution was provided at a room temperature for about 30 seconds.

COMPARATIVE EXAMPLE 10

A cleaning solution including sulfuric acid and deionized water was prepared. A volume ratio between the sulfuric acid and the deionized water was about 1:250. The cleaning solution was provided onto an integrated circuit substrate including exposed aluminum patterns while the integrated circuit substrate was rotated at a speed of about 20 rpm. At that time, the cleaning solution had a thickness of about 2 mm on the integrated circuit substrate. The cleaning solution was provided at a room temperature for about 30 seconds.

COMPARATIVE EXAMPLE 11

A cleaning solution including isopropyl alcohol and deionized water was prepared. A volume ratio between the isopropyl alcohol and the deionized water was about 1:1,000. The cleaning solution was provided onto an integrated circuit substrate including exposed aluminum patterns while the integrated circuit substrate was rotated at a speed of about 20 rpm. At that time, the cleaning solution had a thickness of about 2 mm on the integrated circuit substrate. The cleaning solution was provided at a room temperature for about 30 seconds.

COMPARATIVE EXAMPLE 12

A cleaning solution including acetic acid and deionized water was prepared. A volume ratio between the acetic acid and the deionized water was about 1:1,000. The cleaning solution was provided onto an integrated circuit substrate including exposed aluminum patterns while the integrated circuit substrate was rotated at a speed of about 20 rpm. At that time, the cleaning solution had a thickness of about 2 mm on the integrated circuit substrate. The cleaning solution was provided at a room temperature for about 30 seconds.

COMPARATIVE EXAMPLE 13

A cleaning solution including deionized water was prepared. The cleaning solution was provided onto an integrated circuit substrate including exposed aluminum patterns while the integrated circuit substrate was rotated at a speed of about 20 rpm. At that time, the cleaning solution had a thickness of about 2 mm on the integrated circuit substrate. The cleaning solution was provided at a room temperature for about 30 seconds.

COMPARATIVE EXAMPLE 14

A cleaning solution including deionized water was prepared. The cleaning solution was provided onto an integrated circuit substrate including exposed aluminum patterns while the integrated circuit substrate was rotated at a speed of about 20 rpm. At that time, the cleaning solution had a thickness of about 2 mm on the integrated circuit substrate. The cleaning solution was provided at a temperature of about 65° C. for about 30 seconds. Additionally, an air was provided under a pressure of about 5 psi.

In Examples 1 to 5 and Comparative Examples 1 to 14 were performed concerning samples having the aluminum patterns. The aluminum patterns were formed to have widths of about 0.12 μm through photolithography processes, respectively. As for each sample, a distribution state of impurities on a substrate was primarily probed after the aluminum pattern was formed on the substrate by an identical process. After the cleaning processes in accordance with the above Examples and the comparative Examples were performed concerning the samples, the distribution state of impurities on the substrate was secondarily probed. Table 1 shows removal degrees of the impurities on the substrate according to kinds of the cleaning solutions.

TABLE 1

| kinds of cleaning solution | 10W | 30W | 50W | 100W |
|---|---|---|---|---|
| Example 1 | O | — | O | O |
| Example 2 | O | — | O | O |
| Example 3 | O | — | O | O |
| Example 4 | O | — | O | O |
| Example 5 | O | — | O | O |
| Comparative Example 1 | O | — | O | O |
| Comparative Example 2 | O | — | O | O |
| Comparative Example 3 | O | — | O | O |
| Comparative Example 4 | O | — | O | O |
| Comparative Example 5 | O | — | O | O |
| Comparative Example 6 | O | — | O | O |
| Comparative Example 7 | O | — | O | O |
| Comparative Example 8 | O | — | O | O |
| Comparative Example 9 | O | — | O | O |
| Comparative Example 10 | O | — | O | O |
| Comparative Example 11 | Δ | — | — | — |
| Comparative Example 12 | Δ | — | — | — |
| Comparative Example 13 | X | — | X | X |
| Comparative Example 14 | Δ | Δ | Δ | O |

In Table 1, symbol O means a good state wherein impurity particles on the integrated circuit substrate were removed by more than about 70 percent. Also, symbol Δ represents a normal state wherein the impurity particles on the integrated circuit substrate were removed by less than about 50 percent. Furthermore, symbol X means a bad state wherein the impurity particles on the integrated circuit substrate were removed by less than about 20 percent. For these Examples and Comparative Examples, powers of mega-sonic energies were applied by about 10 W, about 30 W, about 50 W and about 100 W during the cleaning processes, respectively.

As shown in Table 1, Examples 1 to 5 showed excellent cleaning efficiencies and also Comparative Examples 1 to 10 showed good cleaning efficiencies, respectively.

On the other hand, Comparative Examples 11 and 12 showed relatively poor cleaning efficiency as the impurities remained on the integrated circuit substrates by more than about 50 percents after the cleaning process.

In Comparative Example 13, the cleaning solution might hardly remove the impurities on the integrated circuit substrate so that the impurities remained on the integrated circuit substrate by more than about 80 percent.

In Comparative Example 14, the impurities were sufficiently removed from the integrated circuit substrate when the mage-sonic energy of about 100 W was applied to the film of the cleaning solution. However, Comparative Example 14 generally showed relative poor cleaning efficiency such that the impurities remained on the integrated circuit substrate by more than about 50 percents after the cleaning process was performed.

Table 2 represents corrosion degrees of the aluminum patterns on the integrated circuit substrate in accordance with the kinds of the cleaning solutions.

TABLE 2

| kinds of cleaning solution | 10W | 30W | 50W | 100W |
|---|---|---|---|---|
| Example 1 | X | — | X | X |
| Example 2 | X | — | X | X |
| Example 3 | X | — | X | X |
| Example 4 | X | — | X | X |
| Example 5 | X | — | X | X |
| Comparative Example 1 | O | — | O | O |
| Comparative Example 2 | O | — | O | O |
| Comparative Example 3 | O | — | O | O |
| Comparative Example 4 | O | — | O | O |
| Comparative Example 5 | O | — | O | O |
| Comparative Example 6 | O | — | O | O |
| Comparative Example 7 | X | — | X | X |
| Comparative Example 8 | X | — | X | X |
| Comparative Example 9 | X | — | X | X |
| Comparative Example 10 | X | — | X | X |
| Comparative Example 11 | — | — | — | — |
| Comparative Example 12 | X | — | X | X |
| Comparative Example 13 | X | — | X | X |
| Comparative Example 14 | Δ | Δ | Δ | Δ |

In Table 2, symbol O means a bad state wherein corrosion of the aluminum patterns formed on the integrated circuit device was greatly generated after the cleaning process. Also, symbol Δ represents a normal state wherein the corrosion of the aluminum patterns formed on the integrated circuit device was slightly generated after the cleaning process. Furthermore, symbol X means a good state wherein corrosion of the aluminum patterns formed on the integrated circuit device were not generated after the cleaning process. At that time, powers of mega-sonic energies were applied by about 10 W, about 30 W, about 50 W and about 100 W during the cleaning processes, respectively.

Referring to Table 2, Examples 1 to 5 and Comparative Examples 7 to 10 showed good results because the aluminum patterns on the integrated circuit substrates were not corroded after the cleaning processes.

To the contrary, Comparative Examples 1 to 6 had poor results since the aluminum patterns on the integrated circuit substrates were greatly corroded after the cleaning processes.

While Comparative Examples 12 and 13 showed good results for the corrosions of the aluminum patterns, Comparative Examples 14 showed relative poor results because the aluminum patterns on the integrated circuit substrate were corroded though the corrosion degree of the aluminum patterns was not serious.

Table 3 shows damages of the aluminum patterns in accordance with the kinds of the cleaning solution.

TABLE 3

| kinds of cleaning solution | 10W | 30W | 50W | 100W |
|---|---|---|---|---|
| Example 1 | X | — | O | O |
| Example 2 | X | — | O | O |
| Example 3 | X | — | O | O |
| Example 4 | X | — | O | O |
| Example 5 | X | — | O | O |
| Comparative Example 1 | X | — | O | O |
| Comparative Example 2 | X | — | O | O |
| Comparative Example 3 | X | — | O | O |
| Comparative Example 4 | X | — | O | O |
| Comparative Example 5 | X | — | O | O |
| Comparative Example 6 | X | — | O | O |
| Comparative Example 7 | X | — | O | O |
| Comparative Example 8 | X | — | O | O |
| Comparative Example 9 | X | — | O | O |
| Comparative Example 10 | X | — | O | O |
| Comparative Example 11 | — | — | — | — |
| Comparative Example 12 | X | — | O | O |
| Comparative Example 13 | X | — | O | O |
| Comparative Example 14 | X | O | O | O |

In Table 3, symbol O means a bad state wherein damages like breaks or cracks of the aluminum patterns formed on the integrated circuit device were greatly generated after the cleaning process. In the meantime, symbol X means a good state wherein the damages like breaks or cracks of the aluminum patterns formed on the integrated circuit device were not generated after the cleaning process. At that time, powers of mega-sonic energies were applied by about 10 W, about 30 W, about 50 W and about 100 W during the cleaning processes, respectively.

As shown in Table 3, in Examples 1 to 5 and Comparative Examples 1 to 14, all the aluminum patterns on the integrated circuit substrates were cracked or broken when the mega-sonic energies of more than about 50 W were applied to the cleaning solutions. Particularly, in the comparative Example 14, the aluminum patterns on the integrated circuit substrate were seriously damaged because the air was additionally provided to cause an excessive spray pressure. Thus, the mega-sonic energy of less than about 20 W is advantageously maintained. The cleaning process may be performed with the mega-sonic energy of about 10 W to 100 W.

Referring to Table 1, Examples 1 to 5, wherein the cleaning solutions including the about 30% aqueous ammonia solution, the acetic acid and the deionized water were used, had cleaning efficiencies substantially equal to those of Comparative Examples 1 to 10 wherein the cleaning solutions including the deionized water and the about 30% aqueous ammonia solution or the sulfuric acid were employed. However, the cleaning solutions of Comparative Examples 1 to 6, which included the deionized water and the about 30% aqueous ammonia solution, were not suitable to the cleaning processes because the aluminum patterns were corroded after the cleaning processes were executed as shown in Table 2. When integrated circuit substrates were cleaned using the cleaning solutions of Comparative Examples 7 to 10 including the sulfuric acid and the deionized water, watermarks were formed on the integrated circuit substrates though the cleaning solutions of Comparative Examples 7 to 10 were adequately cleaned the integrated circuit substrates. Thus, the cleaning solutions of Comparative Examples 7 to 10 are not suitable to the cleaning processes for the integrated circuit substrates because failures like the watermarks may be formed or additional processes should be performed to remove the watermarks.

According to embodiments the present invention, an integrated circuit substrate having exposed aluminum patterns formed thereon is cleaned using a cleaning solution including about 30% aqueous ammonia solution, acetic acid and deionized water and employing a mega-sonic energy of about 10 W. Therefore, a cleaning efficiency of a cleaning process can be improved and the aluminum patterns are corroded little, if at all because the cleaning solution additionally includes the acetic acid and the deionized water into the about 30% aqueous ammonia solution causing the corrosion of the aluminum pattern though the about 30% aqueous ammonia solution has an excellent cleaning strength concerning the aluminum pattern.

In addition, the cleaning process can have an improved cleaning efficiency in accordance with a chemical cleaning effect of the cleaning solution and a physical cleaning effect of the mega-sonic energy.

Furthermore, components of the cleaning solution can be relatively cheap and easily provided to efficiently reduce a manufacturing cost of an integrated circuit device.

It should be noted that many variations and modifications might be made to the embodiments described above without substantially departing from the principles of the present invention. All such variations and modifications are intended to be included herein within the scope of the present invention, as set forth in the following claims.

What is claimed is:

1. A method of cleaning an integrated circuit device comprising:

forming a film of a cleaning solution on an integrated circuit substrate having an exposed metal pattern formed thereon by providing the cleaning solution including about 30% aqueous ammonia solution, acetic acid and a deionized water onto the integrated circuit substrate;

applying mega-sonic energy to the film of the cleaning solution; and cleaning the integrated circuit substrate having the exposed metal pattern by a chemical reaction of the cleaning solution, the mega-sonic energy and an energy generated from an explosion of a bubble in the cleaning solution due to the mega-sonic energy.

2. The method of claim 1, wherein the cleaning solution is continuously sprayed onto the integrated circuit substrate.

3. The method of claim 1, wherein the cleaning solution includes the acetic acid by a volume percent higher then a volume percent of the about 30% aqueous ammonia solution, and the deionized water by a volume percent higher then the volume percent of the acetic acid.

4. The method of claim 3, wherein a volume ratio among the about 30% aqueous ammonia solution, the acetic acid and the deionized water is about 1:1 to 100:1,000 to 100,000.

5. The method of claim 1, further comprising rotating the integrated circuit substrate while forming a film of the cleaning solution.

6. The method of claim 5, wherein the integrated circuit substrate is rotated at a speed of about 8 to about 50 rpm.

7. The method of claim 1, wherein the metal pattern includes aluminum.

8. The method of claim 1, wherein the film of the cleaning solution has a thickness of about 0.7 to 2.7 mm.

9. The method of claim 1, further comprising rinsing the integrated circuit substrate using deionized water.

10. A method of cleaning an integrated circuit device comprising:

immersing an integrated circuit substrate having an exposed metal pattern into a cleaning solution including about 30% aqueous ammonia solution, acetic acid and a deionized water;

applying mega-sonic energy to the cleaning solution; and cleaning the integrated circuit substrate having the exposed metal pattern by a chemical reaction of the cleaning solution, the mega-sonic energy and an energy generated from an explosion of a bubble in the cleaning solution due to the mega-sonic energy.

11. The method of claim 10, wherein a volume ratio among the about 30% aqueous ammonia solution, the acetic acid and the deionized water is about 1:1 to 100:1,000 to 100,000.

12. A method of cleaning an integrated circuit device comprising applying mega-sonic energy to a cleaning solution on an integrated circuit device wherein said cleaning solution comprises about 30% aqueous ammonia solution, acetic acid and deionized water.

13. The method of claim 12, wherein the cleaning solution comprises the acetic acid by a volume percent higher than a volume percent of the about 30% aqueous ammonia solution, and the deionized water by a volume percent higher than the volume percent of the acetic acid.

14. The method of claim 13, wherein a volume ratio among the about 30% aqueous ammonia solution, the acetic acid and the deionized water is about 1:1 to 100:1,000 to 100,000.

15. The method of claim 12, wherein the mega-sonic energy is applied at about 10 to 100 W.

16. The method of claim 12, further comprising rinsing the integrated circuit substrate using deionized water.

17. The method of claim 12, wherein the mega-sonic energy is applied at a frequency great enough to produce a vibration to generate an explosion of a bubble in the cleaning solution.

18. The method of claim 17, wherein the mega-sonic energy is applied in an amount sufficient to explode ammonia gases saturated in the cleaning solution.

19. A method of cleaning an integrated circuit device comprising:

immersing an integrated circuit substrate having an exposed metal pattern formed thereon in a cleaning solution wherein said cleaning solution comprises about 30% aqueous ammonia solution, acetic acid and deionized water; and applying mega-sonic energy to the cleaning solution.

20. The method of claim 19, wherein the cleaning solution comprises the acetic acid by a volume percent higher than a volume percent of the about 30% aqueous ammonia solution, and deionized water by a volume percent higher than the volume percent of the acetic acid.

21. The method of claim 20, wherein a volume ratio among the about 30% aqueous ammonia solution, the acetic acid and the deionized water is about 1:1 to 100:1,000 to 100,000.

22. The method of claim 19, wherein the metal pattern includes aluminum.

23. The method of claim 19, wherein the mega-sonic energy is applied at about 10 to 100 W.

24. The method of claim 19, further comprising the integrated circuit device using deionized water.

25. A method of cleaning an integrated circuit device comprising:

forming a film comprising a cleaning solution on an integrated circuit device, wherein said cleaning solution comprises about 30% aqueous ammonia solution, acetic acid and deionized water, and applying mega-sonic energy to the cleaning solution.

26. The method of claim 25, wherein the mega-sonic energy is applied at a frequency great enough to produce a vibration to generate an explosion of a bubble in the cleaning solution.

27. The method of claim 26, wherein the mega-sonic energy is applied at about 10 to 100 W.

28. The method of claim 25, wherein a volume ratio among the about 30% aqueous ammonia solution, the acetic acid and the deionized water is about 1:1 to 100:1,000 to 100,000.

29. The method of claim 25, wherein the cleaning solution is continuously sprayed onto the integrated circuit device.

30. The method of claim 25, wherein the cleaning solution includes the acetic acid by a volume percent higher than a volume percent of the about 30% aqueous ammonia solution, and the deionized water by a volume percent higher than the volume percent of the acetic acid.

31. The method of claim 25, further comprising rotating the integrated circuit device while forming the film comprising a cleaning solution.

32. The method of claim 25, wherein the integrated circuit device is rotated at a speed of about 8 to about 50 rpm.

33. The method of claim 25, wherein the film of the cleaning solution has a thickness of about 0.7 to about 2.7 mm.

34. The method of claim 25, further comprising rinsing the integrated circuit device using deionized water.

35. The method of claim 25, wherein the mega-sonic energy is applied in an amount sufficient to explode ammonia gases saturated in the cleaning solution.

36. The method of claim 25, wherein the integrated circuit device has an exposed metal pattern.

* * * * *